United States Patent [19]

Oyama

[11] Patent Number: 4,523,174

[45] Date of Patent: Jun. 11, 1985

[54] ILLUMINATION TYPE ROTARY VARIABLE RESISTOR

[75] Inventor: Akira Oyama, Miyagi, Japan

[73] Assignee: Alps Electric Co., Ltd., Tokyo, Japan

[21] Appl. No.: 575,887

[22] Filed: Feb. 1, 1984

[30] Foreign Application Priority Data

Feb. 1, 1983 [JP] Japan ..... 58-12033[U]

[51] Int. Cl.[3] ..... H01C 10/30

[52] U.S. Cl. ..... 338/119; 338/196; 338/191; 338/200

[58] Field of Search ..... 338/119, 162, 196, 191, 338/172, 200; 116/286, 309; 250/227; 350/96.15

[56] References Cited

U.S. PATENT DOCUMENTS 2,492,286 12/1949 Hermann ..... 338/119

3,997,864 12/1976 Oka et al. ..... 338/119

4,363,018 12/1982 Matsui et al. ..... 338/191

*Primary Examiner*—Roy N. Envall, Jr.

*Assistant Examiner*—C. N. Sears

*Attorney, Agent, or Firm*—Guy W. Shoup; Gerard F. Dunne

[57] ABSTRACT

Disclosed is an illumination type rotary variable resistor, in which a hollow shaft rotatable and displacable in the thrust direction and is coupled to a rotatable knob, in which a photo-conductive element is disposed within the hollow shaft and the knob, in which one end of the photo-conductive element is exposed at an end surface of the knob, in which a light source is provided close to the other end of the photo-conductive element, in which a driver member is placed in contact with a forward end of the hollow shaft to cause a switch to perform its switching operation, and in which a reflex surface is formed on the driver member to reflect light from the light source towards the photo-conductive element.

5 Claims, 5 Drawing Figures

ILLUMINATION TYPE ROTARY VARIABLE RESISTOR

FIELD OF THE INVENTION

The present invention relates to a rotary variable resistor.

SUMMARY OF THE INVENTION

An object of the present invention is to provide a rotary variable resistor which can actuate a switch mechanism by axial movement of its operation knob and yet can provide a light spot indicating the rotary position of the knob.

DETAILED DESCRIPTION OF THE PREFERRED EMBODIMENT

Referring to FIGS. 1 to 5, a preferred embodiment of the present invention will be described hereunder.

Figure 1:
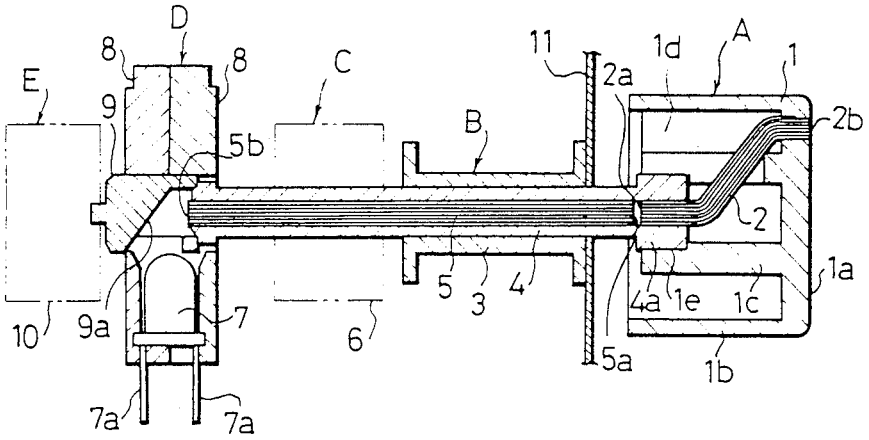
FIG. 1 a side cross-section of the illumination type rotary variable resistor according to an embodiment of the present invention.

In FIG. 1, the illumination type rotary variable resistor includes a knob section A, a shaft section B, a variable resistor section C, a light source section D and a switch section E.

Figure 2:
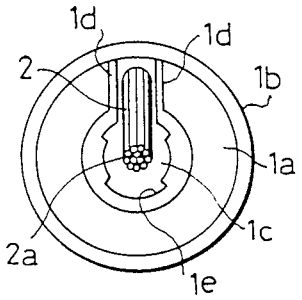
FIG. 2 is a view of the knob portion of FIG. 1 when viewed from the back side of the knob portion.

The knob section A includes a knob 1 and a second photo-conductive element 2. The knob 1 has an end surface 1*a* and an annular jetty portion 1*b* extends rearwardly from the end surface 1*a* as shown in FIG. 1. The interior of the knob 1 include a cylindrical projection 1*c* formed coaxially with the annular jetty portion 1*b*, a pair of partitions 1*d*, 1*d* connected to the cylindrical projection 1*c* and a fitting hold 1*e* as shown in FIGS. 1 and 2. The second photo-conductive element 2 is disposed within the knob 1 as shown in FIGS. 1 and 2. In the knob 1, the second photo-conductive element 2 is bent such that the base end 2*a* thereof is disposed at the center of rotation of the knob 1 and the forward end 2*b* is disposed at a position on the end surface 1*a* which is radially offset from the center of rotation of the knob 1 so that a display can be made thereat. The shaft section B includes a shaft bearing 3, a hollow shaft 4 supported by the shaft bearing 3 for rotation as well as axial movement and a first photo-conductive element 5 as shown in FIG. 1. A flange 4*a* formed at the rightward end of the hollow shaft 4 in the drawing is fixed within the fixing hold 1*e* so that the hollow shaft 4 is rotated when the knob 1 is rotated and displaced leftwardly in the drawing when the knob 1 is pushed leftwardly. The right end 5*a* of the first photo-conductive element 1 is in opposition to the base end 2*a* of the second photo-conductive element 2 and the left end 5*b* of the first photo-conductive element 5 is in opposition to a reflex surface 9*a* of a driver 9 which will be described later.

The variable resistor section C is constituted by a variable resistor 6 the resistance of which varies when a slider slides on a resistive layer on an insulator substrate (all not shown). The slider is rotated by the rotation of the hollow shaft 4.

The light source section D is constituted by a light source 7 including an LED and provided with terminals 7*a*. A pair of casings 8, 8 made of a synthetic resin material such as PBT (polybutylene terephthalate) holds the light source 7, and the above-mentioned driver 9 is made of a synthetic resin material such as PBT inserted into the casings 8, 8 for sliding movement in the axial direction of the hollow shaft 4. The driver 9 is provided at its inside with the above-mentioned reflex surface 9*a* so that the light from the light source 7 disposed at a position perpendicular to the axis of the first photo-conductive element 5 is reflected by the reflex survace 9*a* to impinge onto the end surface 5*b* of the first photo-conductive element 5. On the outer periphery of the driver 9 are formed a pair of slide rods 9*b*, 9*b* which are slidably fitted into a pair of guide grooves 8*a*, 8*a* formed inside the insulating casings 8, 8 whereby the sliding distance of the driver 9 in the axial direction of the hollow shaft 4 is restricted. The forward end of the hollow shaft 4 is made to contact with the right end of the driver 9 so that the driver 9 moves in the axial direction of the hollow shaft as the hollow shaft 4 is moved axially.

The switch section E is formed by a switch 10, such as a push-push switch in which on and off states are alternatively attained by successively depressing an actuator (not shown). A push-momentary switch is held in the on-state when an actuator (not shown) is depressed, and the normal off-state is recovered when the actuator is released. The actuator (not shown) of the switch 10 is made to contact the projection 9*c* formed at the forward end of the driver 9, so that the actuation of the switch 10 is performed by the displacement of the driver in the axial direction of the hollow shaft 4.

Reference numeral 11 is a meter board and 12 a scale formed on the meter board.

Figure 3:
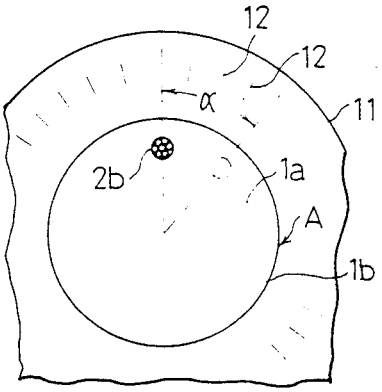
FIG. 3 is a view of the knob portion of FIG. 1 when viewed from the front side of the knob portion.
Figure 4:
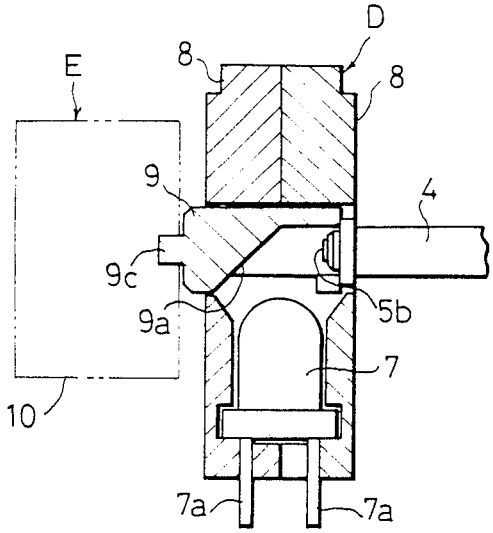
FIG. 4 is an enlarged side cross-section of the light source portion of FIG. 1.
Figure 5:
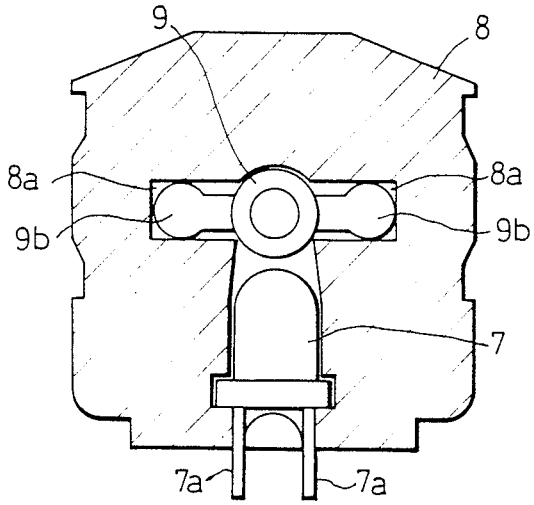
FIG. 5 is an enlarged front cross-section of the light source portion of FIG. 1.

In such an arrangement, when the knob 1 is rotated counterclockwise by an angle $\alpha$ as shown in FIG. 3, the forward end 2*b* of the second photo-conductive element 2 exposed on the end surface 1*a* of the knob 1 is also displaced to the position indicated by a phantom line as shown in FIG. 3. Being fixedly coupled with the knob 1, the hollow shaft 4 is also rotated by the angle $\alpha$ as the knob 1 rotates, so that the slider (not shown) of the variable resistor 6 is rotated by the rotation of the hollow shaft 4 to thereby vary the resistance value of the resistor.

The light from the light source 7 reflected onto the reflex surface 9*a* of the driver 9, impinges onto the end portion 5*b* of the first photo-conductive element 5, and is transferred to the forward end 2*b* of the second photo-conductive element 2 exposed on the end surface 1*a* of the knob 1 throught the first and second photo-conductive elements 5 and 2. Thus, the angle of rotation of the knob 1 is optically indicated at the end surface 1*a* of the knob 1 so that the resistance value of the variable resistor 6 and therefore a quantity, such as a sound volume, determined by the resistance value, can be diretly read out on the scale 12 of the meter board 11.

When the knob 1 is pushed toward the meter board 11, the hollow shaft 4 connected to the knob 1 and the driver 9 contacting the forward end of the hollow shaft 4 are displaced leftwardly in the drawing in the direction of thrust, so that the state of the switch 10 is changed by the forward end projection 9*c* of the driver 9. However, the light from the light source 7 can still be effectively reflected by the reflex surface 9*a* of the driver 9 toward the first photo-conductive element 5, even when the distance between the light source 7 and the end portion 5*b* of the first photo-conductive element 5 is changed by the displacement of the driver 9 in the direction of thrust. Then, when the knob 1 is released from the depression force, the driver 9 is returned rightwardly in the drawing by means of a return spring (not shown) provided in the switch 10, whereby the hollow shaft 4 and the knob 1 are returned to their original positions.

The illumination type rotary variable resistor according to the present invention is arranged, as described above, such that a rotatable hollow shaft displacable in its axial direction is coupled to a rotatable knob, and a photo-conductive element is disposed within the hollow shaft and the knob. One end of the photo-conductive element is exposed at an end surface of the knob, and a light source is provided close to the other end of the photo-conductive element. A driver member is placed in contact with a forward end of the hollow shaft to cause a switch to perform its switching operation, and a reflex surface is formed on the driver member to reflect light from the light source towards the photo-conductive element, so that the light from the light source can be displayed at the end surface of the knob by utilizing the reflex surface formed on the driver member on one hand even when the hollow shaft is displaced axially, and the switching operation of the switch is attained by the driver member.

What is claimed is:

1. An illumination type rotary variable resistor comprising a rotatable hollow shaft displaceable axially, a rotatable knob coupled to a forward end of said hollow shaft, a photo-conductive element disposed within said hollow shaft and said knob and having two ends one of which is exposed eccentrically at an end surface of said knob, a light source provided close to the other end of said photo-conductive element, a switch located rearwardly of said hollow shaft, a driver member disposed in contact with the rearward end of said hollow shaft to cause said switch to perform its switching operation upon axial movement of said hollow shaft, and means including, a reflective surface formed on said driver member to reflect light from said light source and to direct the reflected light towards said photo-conductive element regardless of the axial position of said hollow shaft.

2. An illumination type rotary variable resistor according to claim 1, in which said one end of said photo-conductive element is exposed at a position on said end surface of said knob at a distance from the center of rotation of said knob.

3. An illumination type rotary variable resistor according to claim 1, in which said driver member is displaced in the direction of thrust together with the displacement of said hollow shaft in the same direction.

4. In a rotary variable resistor having an operation shaft, a rotary knob connected to one end of said operation shaft for rotating said shaft to actuate said variable resistor, and means connected to said operation shaft for actuating a switch mechanism upon axial movement of said operation shaft, the improvement including means for illuminating a portion of said knob for indicating the rotational position thereof, said illuminating means including an elongate light-transmission means extending through said operation shaft and having a first end portion extending eccentrically to the face of said knob and a second end portion extending axially from said operation shaft, a light source adapted to emit light angularly towards said second end portion, and reflection means including a reflective surface adapted to reflect light from said light source towards said second end portion regardless of the axial position of said operation member.

5. A rotary variable resistor according to claim 4, said reflection means including a member contacting said operation shaft and adapted to move axially therewith for operating said switch mechanism.

* * * * *